US007396105B2

(12) United States Patent
Toki et al.

(10) Patent No.: US 7,396,105 B2
(45) Date of Patent: Jul. 8, 2008

(54) INK JET RECORDING APPARATUS

(75) Inventors: Nobuhiro Toki, Kawasaki (JP); Tetsuya Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 373 days.

(21) Appl. No.: 11/188,631

(22) Filed: Jul. 26, 2005

(65) Prior Publication Data

US 2006/0023022 A1 Feb. 2, 2006

(30) Foreign Application Priority Data

Jul. 30, 2004 (JP) ..... 2004-222753

(51) Int. Cl.
*B41J 2/165* (2006.01)

(52) U.S. Cl. ..... 347/35; 347/29; 347/30; 347/32

(58) Field of Classification Search ..... 347/22, 347/23, 29, 30, 32, 33, 35
See application file for complete search history.

(56) References Cited

U.S. PATENT DOCUMENTS 5,903,287 A 5/1999 Ishikawa et al.
6,050,671 A * 4/2000 Rotering ..... 347/35
6,196,658 B1 * 3/2001 Rhodes et al. ..... 347/29
6,619,783 B2 * 9/2003 Kanaya et al. ..... 347/35
6,890,069 B2 * 5/2005 Matsui ..... 347/100

FOREIGN PATENT DOCUMENTS

JP 2003-53986 2/2003

* cited by examiner

*Primary Examiner*—shih-wen hsieh
(74) *Attorney, Agent, or Firm*—Fitzpatrick, Cella, Harper & Scinto

(57) ABSTRACT

Even in the case where preliminary ejection is performed by a recording head having an array of pigment ink ejection outlets and an array of dye ink ejection outlets in which a length of the pigment ink ejection outlet array is longer than a length of the dye ink ejection outlet array, deposition of preliminarily ejected pigment ink at a preliminary ejection receiving portion is effectively prevented by providing an inclined surface at the preliminary ejection receiving portion so that ink from the dye ink ejection outlets is received at an upstream position of the inclined surface and ink from the pigment ink ejection outlets is received at a downstream position of the inclined surface in a direction of gravity.

9 Claims, 6 Drawing Sheets

INK JET RECORDING APPARATUS

FIELD OF THE INVENTION AND RELATED ART

The present invention relates to an ink jet recording apparatus for effecting recording with pigment ink and dye ink.

A recording apparatus having a function of a printer, a copying machine, a facsimile apparatus, and the like or a recording apparatus used as output equipment for multipurpose electronic equipment, including a computer, a word processor, and the like, or a work station is constituted so as to form an image on a recording medium, such as paper or a plastic sheet, on the basis of image information. Of these recording apparatuses, an ink jet recording apparatus which effects recording by ejecting ink from a recording head to the recording medium has advantages that the recording head can be easily made compact, that a high-definition image can be recorded at high speed, that recording on plain paper can be performed with no particular treatment, that it is of a non-impact type to result in a low noise, and that a color image with multiple types of ink can be formed easily.

In the above described ink jet recording apparatus, as the recording head, one having an array of minute ejection outlets is generally used, so that contamination of a bubble or dust or an increase in viscosity of ink with evaporation of a solvent for ink is caused to occur, thus resulting in ejection failure of ink droplet in some cases. In the case where such ejection failure is caused to occur, ink in the recording head is refreshed to perform ejection recovery treatment for removing an ejection failure factor.

As a means for performing the ejection recovery treatment, it is possible to use a pressure recovery treatment in which ink in an ejection outlet is forcedly ejected under application of (positive) pressure or a suction recovery treatment in which the ink in the ejection outlet is forcedly sucked under application of negative pressure. Further, it is also possible to use a preliminary ejection means for performing preliminary ejection, during recording, as the ejection recovery treatment. This preliminary ejection is an ink ejection operation performed at a position, at which recording is not effected, in order to avoid an occurrence of ejection failure during the recording, and is ordinarily performed periodically at a certain time interval before start of recording or during the recording. The preliminary ejections can prevent an increase in viscosity of ink due to evaporation of a solvent from ejection outlets which are not used for the recording.

In the ink jet recording apparatus, for the purpose of preventing drying of the ejection outlet surface of the recording head and capping the ejection outlet surface when the above-described pressure recovery or suction recovery is performed, a cap is disposed at a position apart from a recording area in which a recording operation on a recording medium is performed. Further, in some cases, the preliminary ejection is performed with respect to the cap which is utilized as a preliminary ejection receiving portion or a special-purpose preliminary ejection receiving portion. The special-purpose preliminary ejection receiving portion may be disposed at a position adjacent to or in the neighborhood of the cap. However, it has advantages described below by being disposed at a position opposite to the cap with respect to the recording medium during the recording.

More specifically, in order to ensure realization of high speed and high definition of the ink jet recording apparatus, in recent years, ejection outlets of the recording head have been made small and dense. Correspondingly, the preliminary ejection during the recording is required at a shorter time interval. At that time, by providing a preliminary ejection receiving portion at a position opposite to the cap through the recording medium during the recording, it becomes possible to perform the preliminary ejection at both sides of the recording medium by using the preliminary ejection receiving portion and the cap in combination. Further, an excess operation for moving the recording head only for the purpose of the preliminary ejection becomes unnecessary and it is possible to reduce a time required for the preliminary ejection operation in a sequence of recording operations, thus leading to an improvement of throughput of the recording apparatus. This constitution is effective particularly in the case of a large-sized recording medium. Further, by providing an ink absorbing member of a porous material or the like at the preliminary ejection receiving portion, it has been generally performed that the preliminarily ejected ink is absorbed and held.

Further, on the other hand, diversification of ink jet recording is increased, so that an ink jet recording apparatus provided with pigment-based black ink excellent in representation of monochromatic recording of a character or the like in addition to dye-based color ink suitable for color image recording has been popularized. However, in the case where ordinary pigment ink is preliminarily ejected with respect to the above-described preliminary ejection receiving portion provided with the ink absorbing member, a part of the ink component such as carbon black or the like is accumulated because of its nature to result in a deposit in some cases. When a large amount of the deposit is deposited at the preliminary ejection receiving portion, the deposit contacts the neighborhood of the ejection outlets of the recording head during scanning of the recording head to cause ejection failure in some cases. FIG. 6 is a partial perspective view illustrating the above-described deposition of the pigment ink at the preliminary ejection receiving portion. Referring to FIG. 6, the constitution includes a preliminary ejection receiving portion 5, a platen 6, a deposit 54 of pigment ink, a deposit 55 of dye ink, and an ink absorbing member 57 in the preliminary ejection receiving portion 5.

In these circumstances, there has been proposed such a technique that permeation of pigment ink into an ink absorbing member is promoted by mixing the pigment ink with dye ink through preliminary ejection of the dye ink performed depending on preliminary ejection of the pigment ink when the preliminary ejection of the pigment ink is effected, thus reducing the amount of deposited pigment ink component. On the other hand, such a recording head that a pigment ink ejection means is longer than a dye ink ejection means when lengths of the pigment ink ejection means and the dye ink ejection means in a direction of array are compared has been used.

FIG. 4 is a front view showing an array of pigment ink ejection outlets and arrays of pigment ink ejection outlets of such a recording head. In FIG. 4, the recording head includes an ejection outlet surface 31 at which the arrays of ejection outlets are formed, an array 32 of pigment ink ejection outlets comprising a plurality of black pigment ink ejection outlets arranged with a predetermined pitch, and arrays 33 of dye ink ejection outlets comprising a plurality (four in this case) of dye ink ejection outlets for respective colors each arranged with a predetermined pitch. According to the constitution as shown in FIG. 4, it is possible to perform high-speed printing by using only the black pigment ink when monochromatic printing of a character or the like is effected and to perform high-quality printing by using the pigment ink with respect to color printing such as a color image.

Further, on the other hand, an arrangement that the position of the array of pigment ink ejection outlets is shifted as a whole in the direction of array with respect to the position of the arrays of dye ink ejection outlets has also been made. FIG. 5 is a front view showing an ejection outlet surface of a recording head having such an arrangement. In FIG. 5, the same reference numerals as in FIG. 4 represent the same means or members as in FIG. 4. According to the arrangement as shown in FIG. 5, it is possible to effect recording with only the pigment ink previously to perform scanning of the recording head one time or a plurality of times and then to effect recording with the dye ink. As a result, it is possible to effect printing with the color dye ink, after the black pigment ink is sufficiently fixed, with no conveyance of a recording medium during the recording in a reverse direction, so that color mixture or smearing of the pigment ink and the dye ink on the recording medium can be prevented to retain (or improve) image qualities of a recording image.

However, in the conventional ink jet recording apparatus, there arise the following problems to be solved. More specifically, in the case of the recording head in which the array of pigment ink ejection outlets and the arrays of dye ink ejection outlets are shifted from each other in an away (extension) direction, the dye ink and the pigment ink cannot be mixed sufficiently at the preliminary ejection receiving portion, so that there was a possibility of an occurrence of deposition of the pigment ink in an area in which the pigment ink cannot be mixed with the dye ink. An area represented by L1 in FIG. 4 and an area represented by L2 in FIG. 5 are comprise a pigment ink ejection area where the dye ink cannot reach. In this pigment ink ejection area, the pigment ink and the dye ink cannot be mixed sufficiently. In such a case, as shown in FIG. 6, when preliminary ejection of the pigment ink and the dye ink is performed toward the ink absorbing member 57 in the preliminary ejection receiving portion 5 disposed in the neighborhood of the platen 6, the dye ink 55 is immediately absorbed by the ink absorbing member 57 because of its nature but with respect to the pigment ink 54, there is a possibility of deposition thereof on the ink absorbing member 57 because of the nature thereof. When the pigment ink is deposited, there is possibility that the deposited pigment ink contacts the recording head as described above.

SUMMARY OF THE INVENTION

The present invention can provide an ink jet recording apparatus capable of efficiently reducing accumulation of preliminarily ejected pigment ink at a preliminary ejection receiving portion, thus preventing a contact of the accumulated pigment ink with a recording head to permit good image recording even in the case where the preliminary ejection is performed from the recording head in which a length of an array of pigment ink ejection outlets is longer than a length of arrays of dye ink ejection outlets.

According to the present invention, there is provided an ink jet recording apparatus for effecting recording by a recording head having a pigment ink ejection outlet and a dye ink ejection outlet, the recording apparatus comprising:

a preliminary ejection receiving portion; and an inclined surface disposed at the preliminary ejection receiving portion;

wherein the inclined surface for receiving ink from the dye ink ejection outlet includes a portion located at a position which is higher than a position of the inclined surface for receiving ink from the pigment ink ejection outlet in a direction of gravity.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
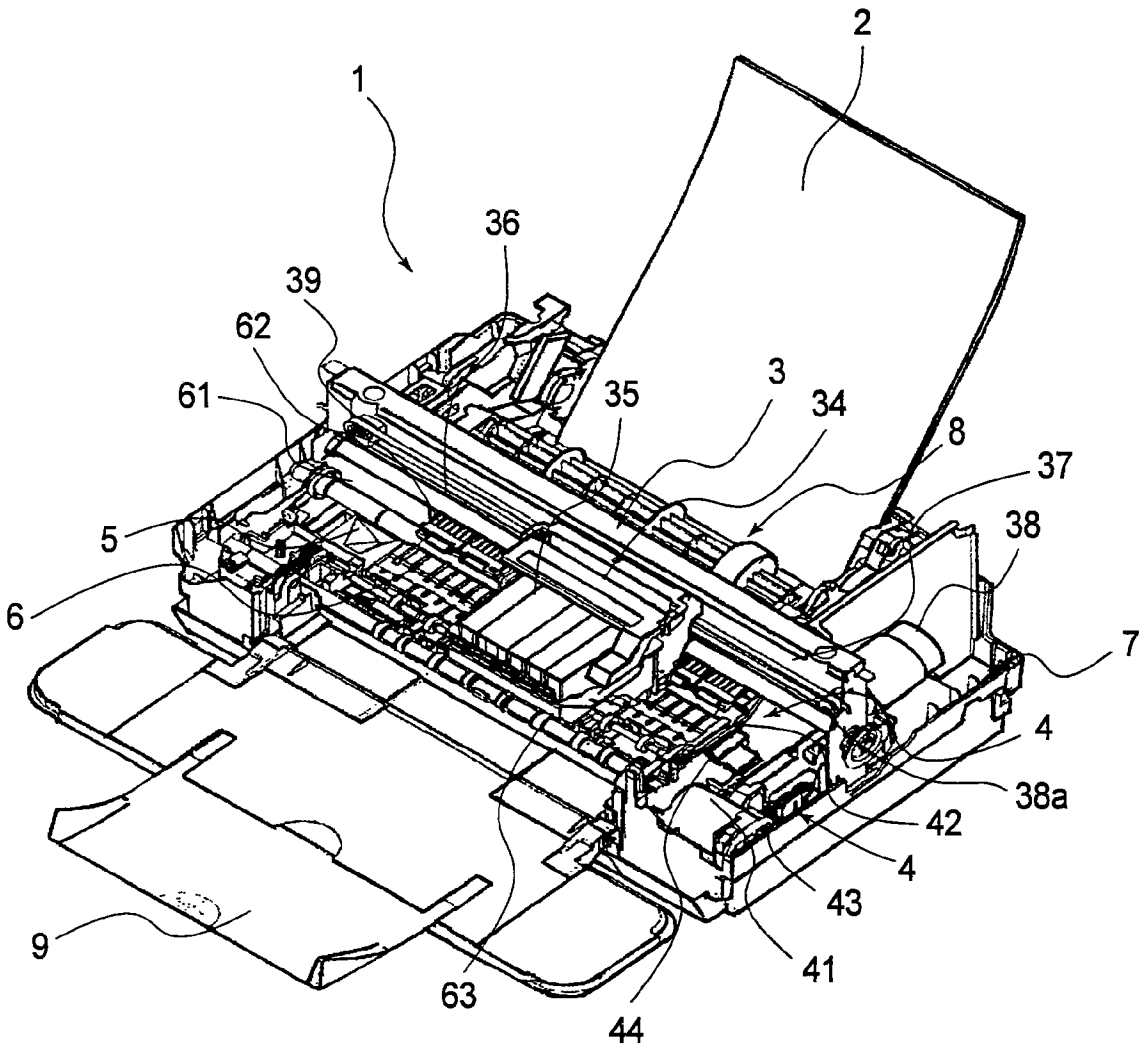
FIG. 1 is a perspective view showing a principal portion of an ink jet recording apparatus according to an embodiment of the present invention.
Figure 2:
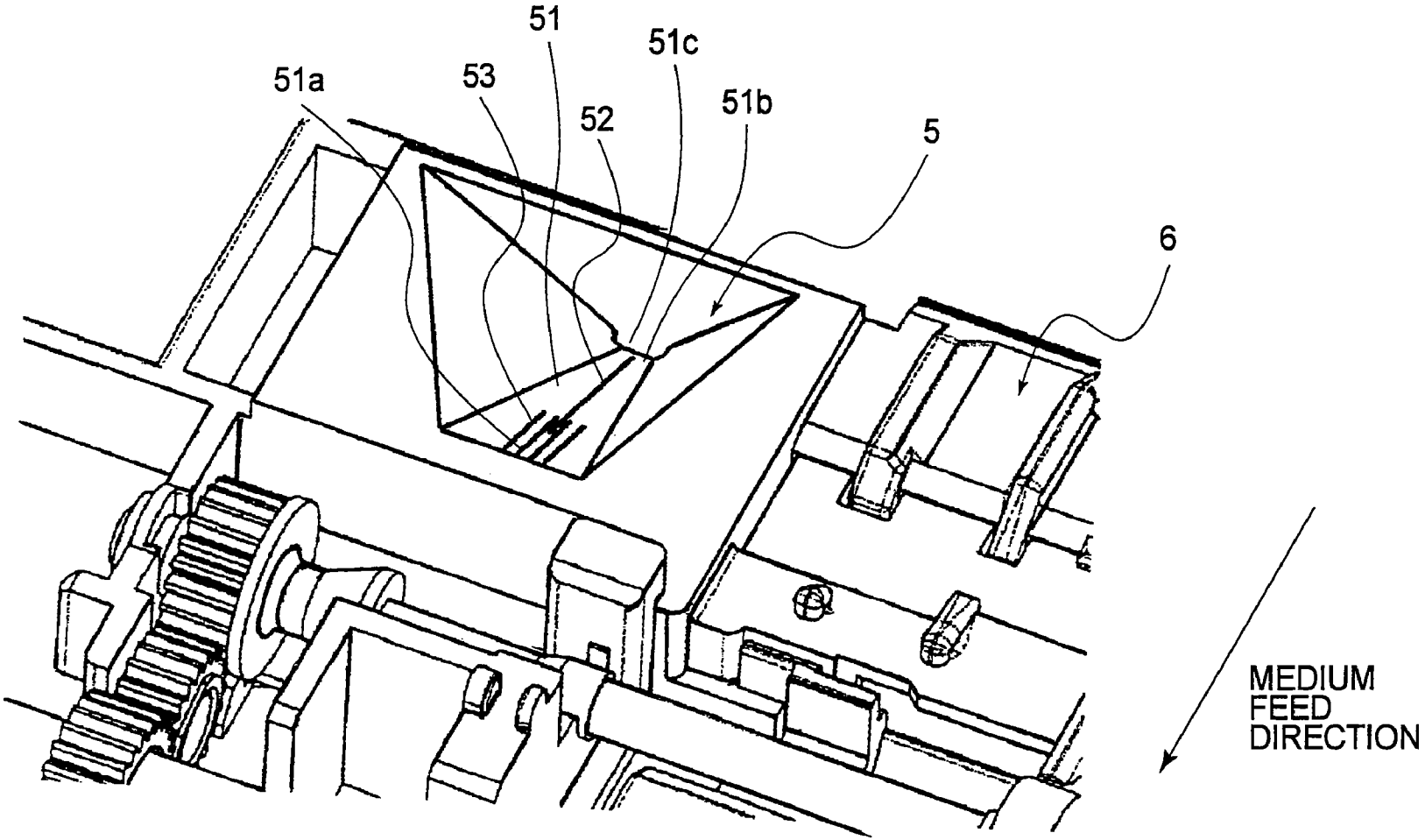
FIG. 2 is a partially perspective view showing a preliminary ejection receiving portion and a preliminary ejection position of an ink jet recording apparatus according to a first embodiment of the present invention.

Hereinbelow, embodiments of the present will be described more specifically with reference to the drawings. Incidentally, in the respective drawings, the same reference numerals represent the same or corresponding means or portions. FIG. 1 is a perspective view showing a principal portion of an ink jet recording apparatus according to an embodiment of the present invention, and FIG. 2 is a partially perspective view showing a preliminary ejection receiving portion and a preliminary ejection position of an ink jet recording apparatus according to a first embodiment of the present invention. In FIGS. 1 and 2, an ink jet recording apparatus 1 includes: a partially shown base (or chassis) 7 of a main assembly of the apparatus; a recording medium 2 of such a recording paper, a plastic sheet, or the like; a paper feed portion 8 for separating and feeding the recording medium one by one; a conveyance (feeding) roller 61 for conveying (feeding) the recording medium 2 through a recording portion; a platen 6 for supporting the recording medium 2 at the recording portion; a recording head, disposed opposite to the platen 6, for effecting recording by ejecting ink; a recovery mechanism portion 4 for retaining and recovering an ink ejection function of the recording head 3 to a normal state; and a paper output tray 9 on which the recording medium 2 is to be placed after the recording.

The recording head 3 effects recording by ejecting ink from ejection outlets to the recording medium 2 on the basis of recording information.

Figure 4:
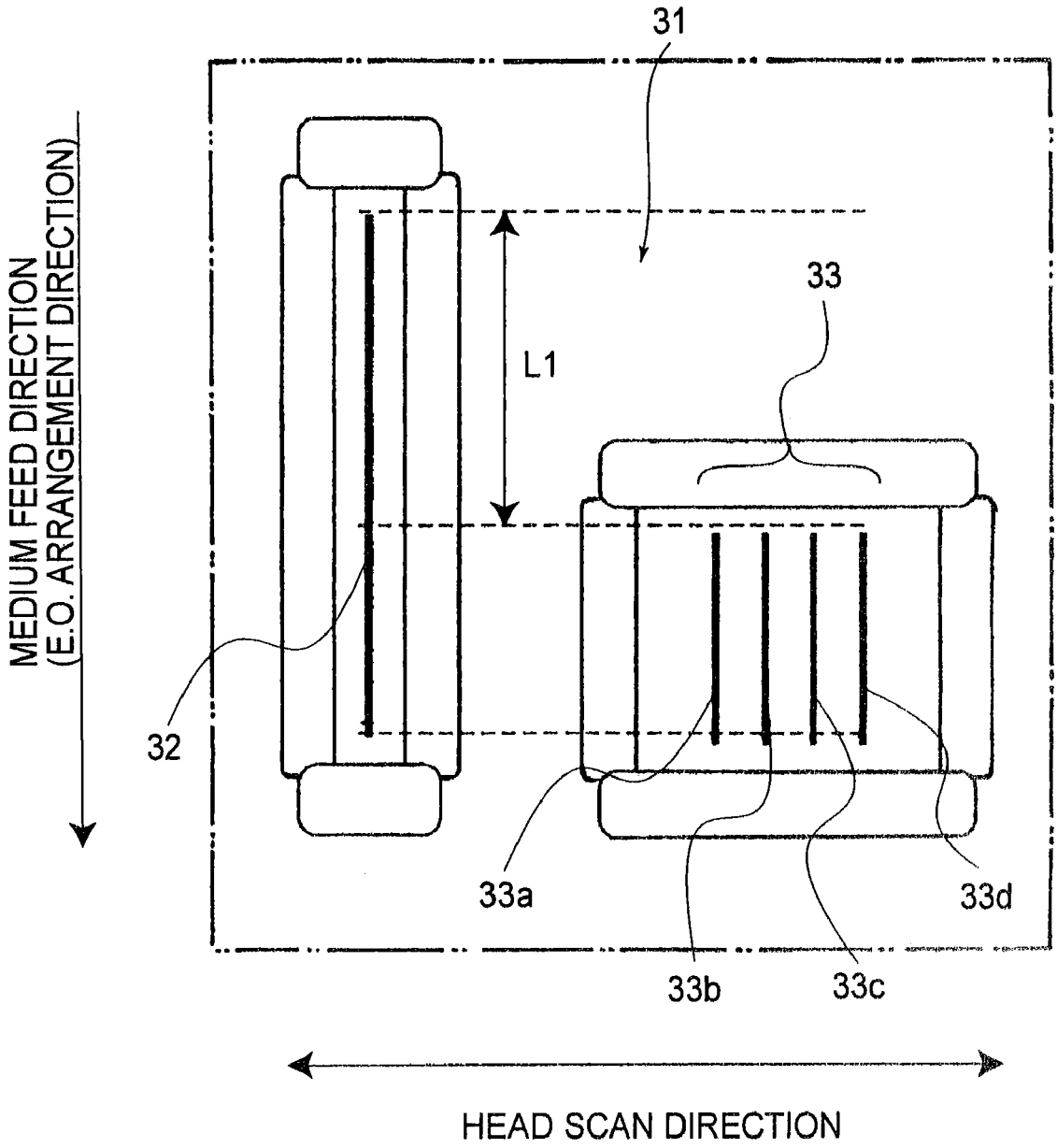
FIG. 4 is a view showing an example of an arrangement state of an array of pigment ink ejection outlets and arrays of dye ink ejection outlets at an ejection outlet surface of a recording head.
Figure 5:
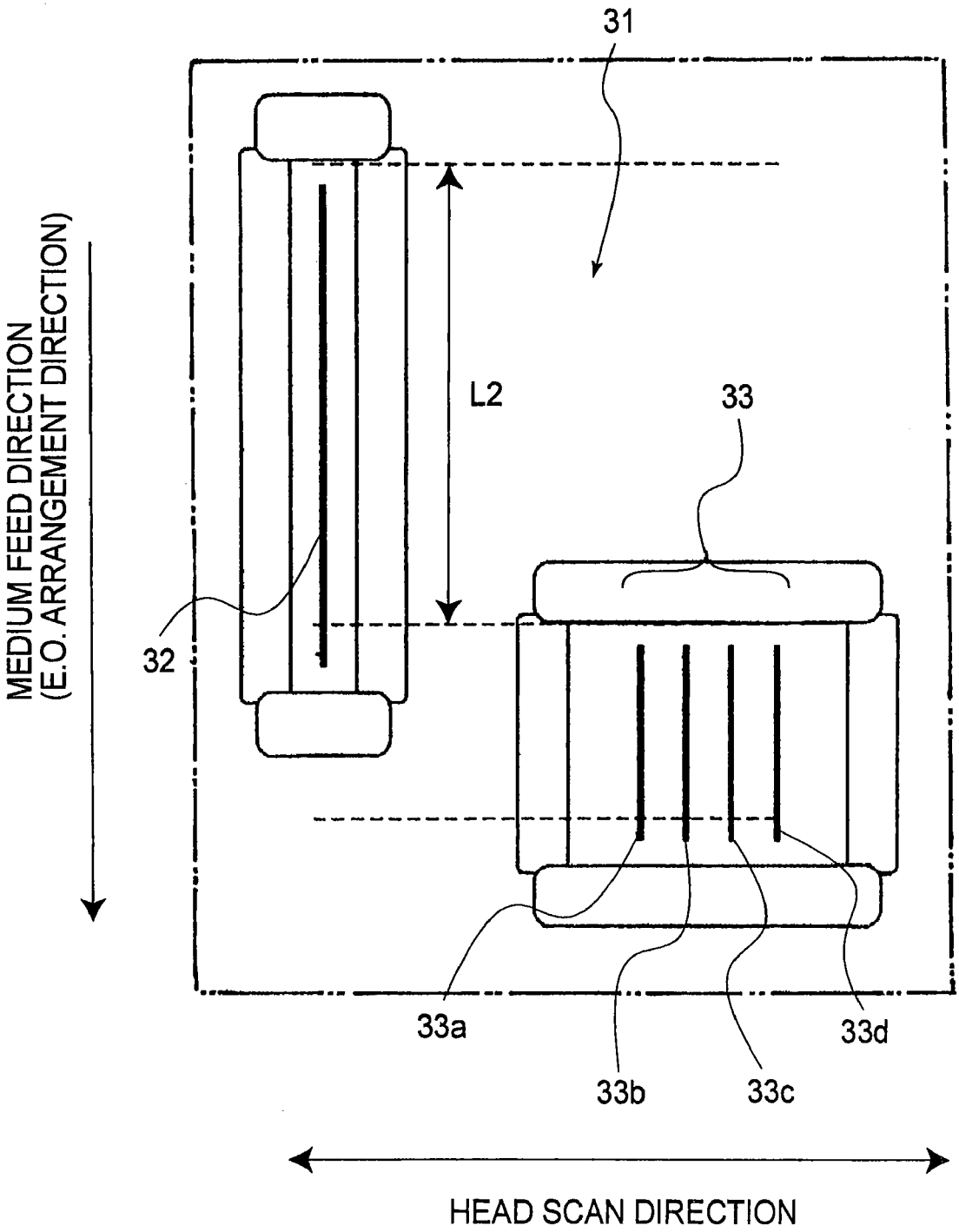
FIG. 5 is a view showing another example of an arrangement state of an array of pigment ink ejection outlets and arrays of dye ink ejection outlets at an ejection outlet surface of a recording head.
Figure 6:
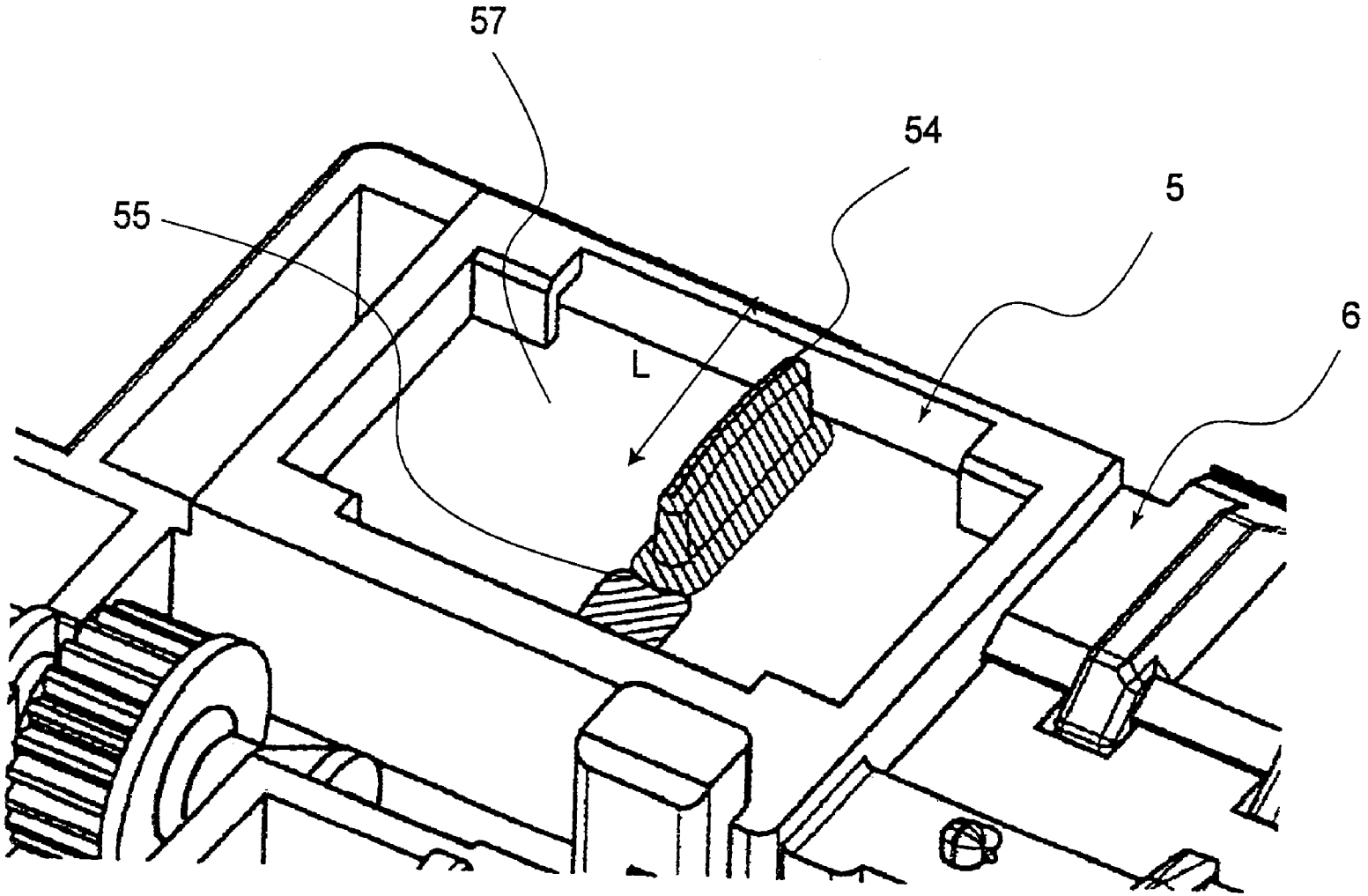
FIG. 6 is a partially perspective view for illustrating a deposition state of pigment ink at a preliminary ejection receiving portion in a conventional ink jet recording apparatus.

FIG. 4 is a view showing an example of an arrangement state of an array of pigment ink ejection outlets and arrays of dye ink ejection outlets at an ejection outlet surface of a recording head, and FIG. 5 is a view showing another example of an arrangement state of an array of pigment ink ejection outlets and arrays of dye ink ejection outlets at an ejection outlet surface of a recording head. Next, recording means comprising the recording head 3 and the like will be described. In FIGS. 1, 2, 4 and 5, the recording head 3 is mounted on a carriage 34 capable of performing reciprocating motion. Further, on the recording head 3, a replaceable ink tank 35 is mounted, and at a portion of the recording head 3 opposite to the platen 6, an ejection outlet surface 31 where arrays of ejection outlets comprising a plurality of ejection outlets are arranged with a predetermined pitch is formed.

In this embodiment, at the ejection outlet surface 31, one array 32 of pigment ink ejection outlets and four arrays 33 (33*a*, 33*b*, 33*c*, 33*d*) of dye ink ejection outlets are formed. The pigment ink ejection outlet array 32 is constituted by a plurality of black pigment ink ejection outlets arranged with a predetermined pitch in a recording medium feed (conveyance) direction. Each of the respective dye ink ejection outlet arrays 33 is constituted by a plurality of color dye ink ejection outlets arranged with a predetermined pitch in the recording medium feed direction. As liquids ejected from the four dye ink ejection outlet arrays 33 (33*a*, 33*b*, 33*c*, 33*d*), it is possible to use, e.g., yellow ink, magenta ink, cyan ink, and a treatment liquid. Further, the black pigment ink ejection outlet array 32 is constituted by an ejection outlet array which is longer than the respective color dye ink ejection outlet arrays 33.

At the ejection outlet surface 31 shown in FIG. 4, with respect to the respective dye ink ejection outlet arrays 33, the pigment ink ejection outlet array 32 is formed so that a downstream end thereof in the recording medium feed direction is in alignment with those of the dye ink ejection outlet arrays 33 and a length thereof is longer than those of the pigment ink ejection outlet arrays 33 by L1 up to an upstream end thereof while shifting its position. Further, at the ejection outlet surface 31 shown in FIG. 5, with respect to the respective dye ink ejection outlet arrays 33, the pigment ink ejection outlet array 32 is shifted as a whole in position toward an upstream side in the recording medium feed direction so that an extended length L2 toward the upstream side is longer than the extended length L1 in the case of FIG. 4.

In FIG. 1, the carriage 34 on which the recording head 3 is mounted in guided and supported so that it can be reciprocated in a main scanning direction along a guide shaft 36 disposed in the main assembly of the recording apparatus. To a carriage motor 38 disposed at one end portion of the chassis 7, a motor pulley 38*a* is provided. A part of a timing belt extended between the motor pulley 38*a* and an idler pulley 39 disposed opposite to the motor pulley 38*a* is connected to the carriage 34. Accordingly, by controlling the rotation and rotation direction of the carriage motor 38, the position and movement of the recording head 3 are controlled.

Against the feed roller 61, a pinch roller 62 is pressed by an urging force exerted by an unshown pinch roller spring, so that the pinch roller 62 is rotated by the rotation of the feed roller 61 to generate a feeding force with respect to the recording medium 2. Against a paper output roller 63, an unshown spur is pressed by an urging force of an unshown spring shaft, so that the spur is rotated by the rotation of the paper output roller 63 to generate a feeding force with respect to the recording medium 2.

In the above constituted ink jet recording apparatus, the recording medium 2 separated and fed from the paper feed portion 8 one by one is fed to a recording start position on the platen 6 by the feed roller 61 rotationally driven by the unshown feeding motor. Further, the carriage 34 is moved by the carriage motor 38 through the timing belt 37, so that image recording is effected by ejecting ink from ejection outlets of the recording head 3 to a predetermined position on the recording medium 2 on the basis of predetermined image information.

When recording scanning of the recording head 3 for one line is completed, the feed roller 61 is rotated again to feed the recording medium 2 by one pitch to a recording start position for a next line, and image recording of the next line is effected by main scanning of the recording head 3. When the recording operation described above is repeated a prescribed time on the basis of predetermined image information to complete recording with respect to the recording medium 2, the recording medium 2 is outputted by the rotation of the output roller 63 to the outside of the apparatus main assembly to be placed on the paper output tray 9.

An ink ejection portion of each of the ejection outlet arrays 32 and 33 of the recording head 3 is constituted by a plurality of minute ejection outlets, liquid passages corresponding to the respective ejection outlets, an energy-acting portion disposed at a part of each liquid passage, and an energy generation means which is disposed at each energy-acting portion and is used for imparting droplet-forming energy to ink. As this energy generation means, it is possible to use a means using an electromechanical transducer such as a piezoelectric device, a means for ejecting a droplet by the action of heat generated by irradiation of electromagnetic wave such as laser or the like, or a means for ejecting a liquid by heating it with an electrothermal converter such as a heater element having a heating resistor.

Of these, an ink jet recording head which ejects a liquid by thermal energy can arrange ejection outlets for forming ejection drops at a high density, thus effecting recording of a high-resolution image. Particularly, a recording head using the electrothermal converter as the energy generation means can be easily reduced in size and can fully utilize merits of IC technology and microprocessing technology which are remarkably improved in technology and reliability in recent years in the semiconductor field, thus being advantageous in terms of high-density packaging and in expensive production costs.

Next, the recovery mechanism portion 4 for retaining and recovering the ink ejection function will be described. A capping means A4 for covering the ejection outlets of the recording head 3 is provided with a cap 42 for the pigment ink ejection outlet array 32 and a cap 43 for the dye ink ejection outlet arrays 33. The capping means 44 is disposed at a position which is apart from a main scanning range (a recording area) for recording within a movement range of the recording head 3 and is a position at which the ejection outlets of the ejection outlet surface 31 can be hermetically capped when the recording head 3 is located at an opposite position. The respective caps 42 and 43 are formed generally of an elastic material and are constituted so that they can be attached to and detached from the ejection outlet surface 31 by driving the capping means 44 in order to cap and uncap corresponding ejection outlet arrays 32 and 33.

The capping means 44 is used for the purposes of protecting the pigment ink ejection outlet array 32 and the dye ink ejection outlet arrays 33 when the recording is not effected, reducing an amount of ink evaporated from the ejection outlets, and performing the pressure recovery treatment or the suction recovery treatment. More specifically, as one of the ejection recovery treatments, a pump 41 connected with the caps 42 and 43 is actuated to forcedly suck ink in the ejection outlets in a state that the respective ejection outlet arrays 32 and 33 are covered with the caps 42 and 43, whereby the ink in the ejection outlets is refreshed to perform the suction recovery treatment for removing ejection failure factors.

Further, other than the above described suction recovery treatment, a recovery treatment by preliminary ejection is performed. This preliminary ejection is performed in such a manner that a preliminary ejection receiving portion (ejection ink receiving portion) 5 is disposed in the movement range of the recording head 3 in the main scanning direction as shown in FIG. 2 (or FIG. 3) and the recording head 3 is driven in such a state that the respective ejection outlet arrays 32 and 33 of the recording head 3 are disposed opposite to the preliminary ejection receiving portion 5 to perform ejection of ink which does not contribute to the recording. Also by this preliminary ejection treatment, similarly as in the case of the above described suction recovery treatment, it is possible to retain and recover the ink ejection function of the recording head to a normal state by removing ejection failure factors such as bubbles and dusts in the ejection outlets and ink which is not suitable for the recording due to an increase in viscosity.

The above described pump 41 is used for, in addition to the action of a sucking force for forced suction of the ink, recovery under suction of waste ink which is received by or remaining in the capping means 44 during the ejection recovery treatment such as the suction recovery treatment using the forced suction or the preliminary ejection treatment. In this embodiment, as the pump 41, it is possible to use, e.g., a tube pump which generates a negative pressure by squeezing an unshown tube by an unshown roller or a piston/cylinder-type pump. Further, a waste ink absorbing member (not shown) for receiving and recovering unnecessary ink (waste ink) which is generated by the suction recovery treatment or the preliminary ejection treatment is disposed at a lower portion of the platen 6.

The preliminary ejection receiving portion 5 as shown in FIG. 2 is disposed at a position which is opposite to the recovery mechanism portion 4 and is in the neighborhood of the platen 6. In this embodiment, the preliminary ejection receiving portion 5 is integrally constituted with the platen 6 and is provided with an inclined surface 51 having an inclined surface upstream portion 51*a* on a downstream side in the feed direction of the recording medium 2 and an inclined surface downstream portion 51*b* on an upstream side in the recording medium feed direction. At the inclined surface downstream portion 51*b*, a hole or opening 51*c* communicating with the unshown waste ink absorbing member disposed at the lower portion of the platen 6 is formed. Further, the preliminary ejection receiving portion 5 is constituted so that it receives, during the preliminary ejection, ink from the dye ink ejection outlet arrays 33 at the inclined surface upstream portion 51*a* which is located upstream in a direction of gravity and ink from the pigment ink ejection outlet array 32 at the inclined surface downstream portion 51*b* which is located downstream in the direction of gravity.

Next, a detailed constitution of the preliminary ejection receiving portion 5 and a preliminary ejection operation at the preliminary ejection receiving portion 5 will be described. In the case where the pigment ink ejection outlet array 32 and the dye ink ejection outlet arrays 33 are arranged while shifting their positions from each other as shown in FIG. 4 or FIG. 5, the preliminary ejection receiving portion 5 is constituted so that preliminarily ejected dye ink 53 is deposited at a position close the inclined surface upstream portion 51*a* of the inclined surface 51 and preliminarily ejected pigment ink 52 is deposited at a position close to the inclined surface downstream portion 51*b* of the inclined surface 51. The preliminarily ejected pigment ink 53 is not readily accumulated but is liable to flow because of its nature, so that most of it flows toward the inclined surface downstream portion 51*b* at an early stage after being deposited at the inclined surface upstream portion 51*a*.

In the area into which the dye ink 53 flows, the preliminarily ejected pigment ink 52 has already been deposited, so that the pigment ink 52 is mixed with the flowed dye ink 53. The pigment ink 52 itself is liable to be accumulated because of its nature but the pigment ink 52 mixed with the dye ink 53 has such a property that it is less accumulated and is liable to flow by the mixing, so that the pigment ink 52 flows together with the dye ink 53 into the waste ink absorbing member disposed at the lower portion of the platen 6 through the hole 51*c* located at the inclined surface downstream portion 51*b*, thus being absorbed and recovered by the waste ink absorbing member.

With respect to an amount of ink used for the pigment ink, an ejection amount of the dye ink is made larger than that of the pigment ink to increase a proportion of the dye ink in the ink mixture, so that the ink mixture is less accumulated and is more liable to flow, thus further effectively reduce (or suppress) the accumulation of the pigment ink. Further, the preliminary ejection of the dye ink may be performed in advance before the preliminary ejection of the pigment ink is performed, so that the ejection of the pigment ink is effected after the dye ink reaches the inclined surface downstream portion 51*b*. As a result, it becomes possible to mix the pigment ink with the dye ink more reliably to permit production of the ink mixture which is liable to flow with reliability, thus being capable of preventing the ink accumulation more effectively.

Figure 3:
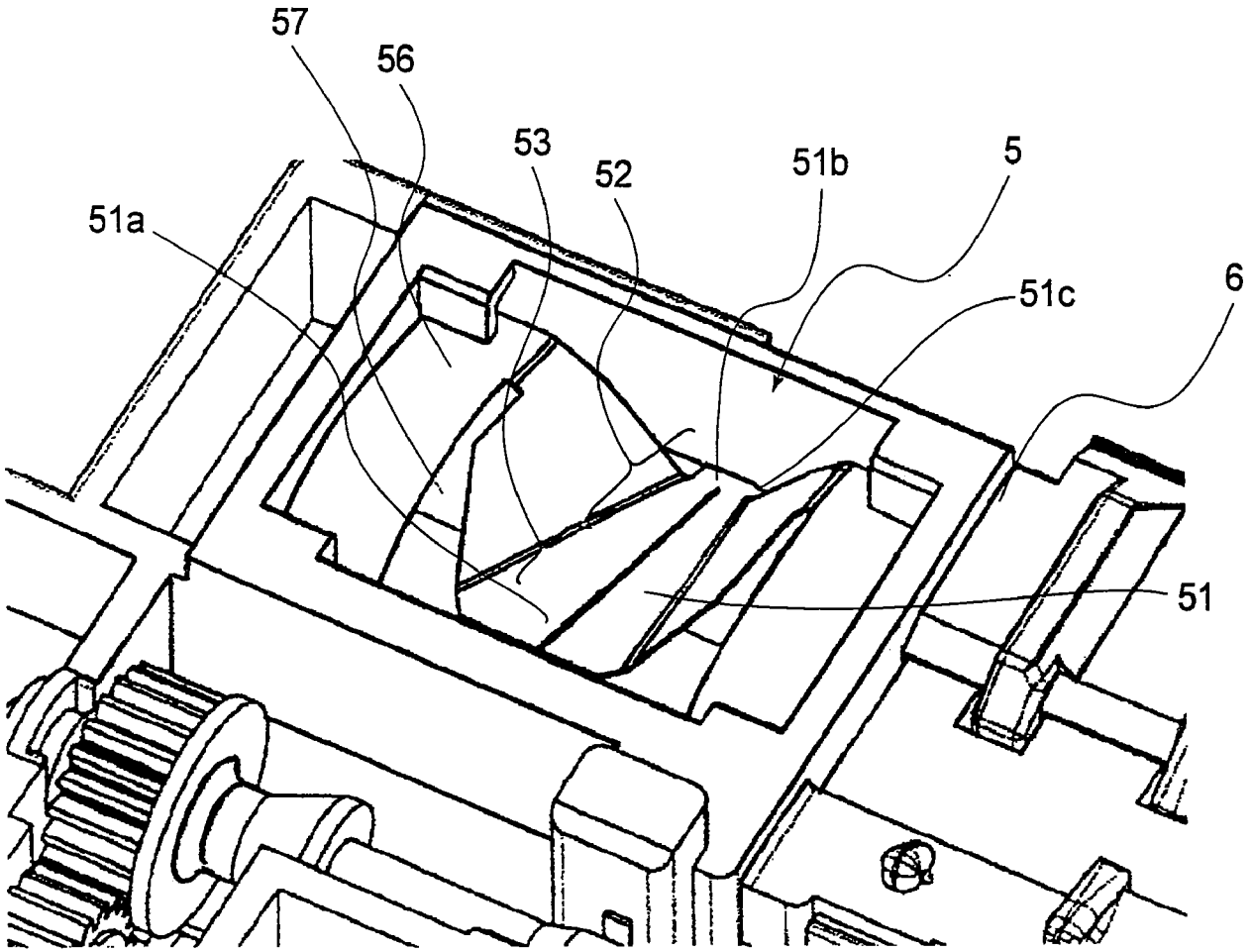
FIG. 3 is a partially perspective view showing a preliminary ejection receiving portion and a preliminary ejection position of an ink jet recording apparatus according to a second embodiment of the present invention.

Further, in this embodiment, the preliminary ejection position 52 of the pigment ink and the preliminary ejection position 53 of the dye ink are selected so as to overlap with each other on a movement path of the recording head 3 in its scanning direction as shown in FIG. 2. By selecting the same preliminary ejection position with respect to the pigment ink and the dye ink, it is possible to mix the pigment ink and the dye ink more reliably. Further, in the case where the recording head 3 has the plurality of the dye ink ejection outlet arrays 33 as in this embodiment, the preliminary ejection positions 53 of the respective dye inks are independently controlled for each of the ejection outlet arrays for the respective colors, so that the preliminary ejection positions 53 of all the dye inks in the recording head movement direction can be aligned with the preliminary ejection position 52 of the pigment ink as shown in FIG. 3 described later. In this manner, by aligning the preliminary ejection positions 52 and 53 of the pigment ink and the dye ink with each other, it becomes possible to mix the pigment ink and the dye ink more reliably to produce the ink mixture which is liable to flow with reliability. As a result, it is possible to further effectively prevent the accumulation of ink.

According to the above described embodiment of the present invention, by an inexpensive constitution without causing an increase in apparatus size, it is possible to provide an ink jet recording apparatus capable of efficiently reducing accumulation of preliminarily ejected pigment ink at a preliminary ejection receiving portion, thus preventing a contact of the accumulated pigment ink with a recording head to permit good image recording even in the case where the preliminary ejection is performed from the recording head in which a length of an array of pigment ink ejection outlets is longer than a length of arrays of dye ink ejection outlets.

FIG. 3 is a schematically partially perspective view showing a preliminary ejection receiving portion 5 and a preliminary ejection position of an ink jet recording apparatus according to a second embodiment of the present invention. In the first embodiment, the preliminary ejection receiving portion 5 and its inclined surface 51 are integrally constituted with the platen 6 but as shown in FIG. 3, they may also be constituted by different members. In this embodiment, an ink receiving surface having the inclined surface 51 is constituted by a film-like member different from other portions. A different member 56 such as a film is fitted in the preliminary ejection receiving portion 5 disposed adjacent to the platen 6, whereby the inclined surface 51 similar to that in the first embodiment is formed. This inclined surface 51 of the different member 56 is also constituted by an inclined surface having an inclined surface upstream portion 51*a* on a downstream side in a feed direction of a recording medium 2 and an inclined surface downstream portion 51*b* on an upstream side of the recording medium feed direction.

Further, the inclined surface 51 is constituted so that it receives, during the preliminary ejection, ink from the dye ink ejection outlet arrays 33 at the inclined surface upstream portion 51*a* which is located upstream in a direction of gravity and ink from the pigment ink ejection outlet array 32 at the inclined surface downstream portion 51*b* which is located downstream in the direction of gravity. Further, at a lower portion of the different member 56 having the inclined surface 51, an ink absorbing member 57 comprising a porous member for absorbing preliminary ejection ink is disposed and contacts a hole or opening 51*c* formed at the inclined surface downstream portion 51*b*. Immediately under the ink absorbing member 57, the above described waste ink absorbing member disposed at the lower portion of the platen 6 is disposed.

In the constitution described above as shown in FIG. 3, pigment ink 52 preliminarily ejected to the inclined surface downstream portion 51*b* of the different member 56 such as a film or the like is mixed with dye ink 53 which is preliminarily ejected to the inclined surface upstream portion 51*a* of the different member 56 or the like and flows after being deposited. Further, the mixed ink flows toward the hole or opening 51*c* formed at the inclined surface downstream portion 51*b*, so that similarly as in the first embodiment, it is possible to achieve the effect of reducing or preventing accumulation of the pigment ink 52. Further, the ink mixture passed through the hole or opening 51*c* at the inclined surface downstream portion 51*b* is once absorbed by the ink absorbing member to be temporarily accommodated therein. When an amount of the accommodated ink exceeds a certain amount, the ink flows from the ink absorbing member 57 to the waste ink absorbing member (not shown) disposed below the ink absorbing member 57 to be absorbed and recovered in the waste ink absorbing member.

At that time, it is possible to improve permeability of the ink in the ink absorbing member 57 by incorporating a hydrophilic substance such as glycerin in advance into the ink absorbing member 57. As a result, it is possible to further smoothly guide the preliminary ejection ink to the waste ink absorbing member.

The second embodiment shown in FIG. 3 has the same constitution as the first embodiment in the other respects, so that explanation thereof will be omitted. Accordingly, also according to the second embodiment, it is possible to achieve the same action and effect as in the case of the first embodiment.

Incidentally, in the above described embodiments, the explanation is made by taking, as an example, the recording head 3 having the relatively long one pigment ink ejection outlet array 32 and the relatively short four dye ink ejection outlet arrays 33. However, the present invention is applicable irrespective of the arrangement of ejection outlets, the number of colors of ink, the length of ejection outlet array, and the like so long as the ink jet recording apparatus employs pigment ink ejection outlets and dye ink ejection outlets, and achieves similar action and effect. Further, the present invention is also similarly applicable to a recording apparatus using one recording head for effecting recording of a single color or a plurality of colors, a color recording apparatus using a plurality of recording heads for effecting recording with different color inks, a gradation recording apparatus using a plurality of recording heads for effecting recording with the same color and a different density, and a recording apparatus having a combination of these recording apparatuses so long as the recording apparatus is an ink jet recording apparatus, and can achieve a similar effect.

Further, the present invention is similarly applicable to any constitution of arrangement of a recording head and an ink tank, such as a constitution using a replaceable ink cartridge comprising a recording head and an ink tank integrally formed with the recording head, a constitution comprising separately prepared ink tanks connected therebetween by an ink supply tube or the like, etc. These cases can also achieve a similar effect.

According to the respective embodiments of the present invention, it is possible to provide an ink jet recording apparatus capable of efficiently reducing accumulation of preliminarily ejected pigment ink at a preliminary ejection receiving portion, thus preventing a contact of the accumulated pigment ink with a recording head to permit good image recording even in the case where the preliminary ejection is performed from the recording head in which a length of an array of pigment ink ejection outlets is longer than a length of arrays of dye ink ejection outlets.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 222753/2004 filed Jul. 30, 2004, which is hereby incorporated by reference herein.

What is claimed is:

1. An ink jet recording apparatus for effecting recording on a conveyed recording medium by an ink jet recording head having a pigment ink ejection outlet array for ejecting pigment ink and a dye ink ejection outlet away for ejecting dye ink, the dye ink ejection outlet array having a length shorter than that of the pigment ink ejection outlet array, said ink jet recording apparatus comprising:

a carriage for mounting and moving the recording head;

a cap for capping ejection outlets of the recording head; and a preliminary ejection receiving portion disposed opposite to said cap in a recording area with respect to a movement direction of the recording head, wherein said preliminary ejection receiving portion has an inclined surface, along a conveyance direction of the recording medium, located so that the dye ink ejection outlet array is disposed upstream from the pigment ink ejection outlet array with respect to a direction of gravity when the recording head is located opposite to said preliminary ejection receiving portion.

2. An apparatus according to claim 1 wherein the dye ink is preliminarily ejected in an amount greater than that of the pigment ink.

3. An apparatus according to claim 1 wherein the pigment ink is preliminarily ejected after the dye ink is preliminarily ejected.

4. An apparatus according to claim 1 wherein in a scanning direction of the recording head, the dye ink and the pigment ink have the same preliminary ejection position.

5. An apparatus according to claim 1 wherein the dye ink ejection outlet array comprises a plurality of arrays of ejection of outlets and each of the arrays has the same preliminary ejection position as the pigment ink ejection outlet array.

6. An apparatus according to claim 1 wherein ink ejected in said preliminary ejection receiving portion is introduced into a waste ink absorbing member through a hole or opening provided at a downstream portion of the inclined surface in the direction of gravity.

7. An apparatus according to claim 1, further comprising a platen for supporting the recording medium at a position opposite to the recording head, wherein said preliminary ejection receiving portion is integrally formed with said platen.

8. An apparatus according to claim 7, wherein the inclined surface is integrally formed with said platen.

9. An apparatus according to claim 1, wherein the inclined surface is separately formed of a film-like member.

* * * * *

UNITED STATES PATENT AND TRADEMARK OFFICE

CERTIFICATE OF CORRECTION

PATENT NO. : 7,396,105 B2
APPLICATION NO. : 11/188631
DATED : July 8, 2008
INVENTOR(S) : Toki et al.

It is certified that error appears in the above-identified patent and that said Letters Patent is hereby corrected as shown below:

COLUMN 3:
Line 27, “comprise” should read --comprised of--.
Line 39, “possibility” should read --a possibility--.

COLUMN 4:
Line 10, “partially” should read --partial--.
Line 14, “partially” should read --partial--.
Line 26, “partially” should read --partial--.
Line 40, “partially” should read --partial--.

COLUMN 7:
Line 57, “close” should read --close to--.

COLUMN 10:
Line 39, “away” should read --array--.

Signed and Sealed this

Third Day of March, 2009

John Doll

JOHN DOLL
*Acting Director of the United States Patent and Trademark Office*